US010184321B2

(12) United States Patent
Mebratu

(10) Patent No.: US 10,184,321 B2
(45) Date of Patent: Jan. 22, 2019

(54) MITIGATING LEAKS IN PRODUCTION TUBULARS

(71) Applicant: HALLIBURTON ENERGY SERVICES, INC., Houston, TX (US)

(72) Inventor: Amare A. Mebratu, Stavanger (NO)

(73) Assignee: Halliburton Energy Services, Inc., Houston, TX (US)

( * ) Notice: Subject to any disclaimer, the term of this patent is extended or adjusted under 35 U.S.C. 154(b) by 332 days.

(21) Appl. No.: 14/556,779

(22) Filed: Dec. 1, 2014

(65) Prior Publication Data

US 2015/0083395 A1 Mar. 26, 2015

Related U.S. Application Data

(63) Continuation of application No. 12/827,794, filed on Jun. 30, 2010, now Pat. No. 8,960,312.

(51) Int. Cl.
*E21B 43/12* (2006.01)
*E21B 43/01* (2006.01)
(Continued)

(52) U.S. Cl.
CPC ..... *E21B 43/0122* (2013.01); *E21B 33/12* (2013.01); *E21B 33/14* (2013.01)

(58) Field of Classification Search
CPC .... E21B 41/005; E21B 43/0122; E21B 47/10; E21B 47/1025; E21B 33/1285; E21B 33/14
See application file for complete search history.

(56) References Cited

U.S. PATENT DOCUMENTS 4,869,324 A 9/1989 Holder
5,271,469 A 12/1993 Brooks et al.
(Continued)

FOREIGN PATENT DOCUMENTS

JP 2001193051 A 7/2001
WO 2008155564 A1 12/2008

OTHER PUBLICATIONS

Mebratu; Amare, Halliburton, Annular Barrier Re-Establishment Using a Long-Life, High-Strength Polmer, SPE 86547, dated Feb. 18-20, 2004, 9 pages.
Halliburton, Swellpacker® Cable System, H04995, dated Aug. 2008, 2 pages.
Halliburton, Swellpacker® Isolation System, H04810, dated Aug. 2008, 2 pages.
(Continued)

*Primary Examiner* — Brad Harcourt
(74) *Attorney, Agent, or Firm* — Locke Lord LLP; Christopher J. Capelli; Joshua L. Jones

(57) ABSTRACT

A well system can include a generally tubular production string extending to a surface location. A production packer seals off an annulus external to the production string. A swellable packer is interconnected in the production string between the production packer and the surface location. A method of mitigating a leak in a generally tubular production string can include interconnecting a swellable packer in the production string, and the swellable packer swelling, and thereby increasingly restricting flow through an annulus surrounding the production string, in response to fluid leakage through a sidewall of the production string. Another method can include interconnecting a swellable packer in the production string, and the swellable packer swelling, and thereby increasingly restricting flow through an annulus surrounding the production string, in response to a flow of hydrocarbons into the annulus from an interior of the production string.

6 Claims, 3 Drawing Sheets

(51) Int. Cl.

| | |
|---|---|
| ***E21B 33/12*** | (2006.01) |
| ***E21B 33/14*** | (2006.01) |

(56) References Cited

U.S. PATENT DOCUMENTS

| | | | |
|---|---|---|---|
| 5,337,808 | A | 8/1994 | Graham |
| 5,366,020 | A | 11/1994 | Berzin et al. |
| 6,547,005 | B2 | 4/2003 | Haheim |
| 6,634,431 | B2 | 10/2003 | Cook et al. |
| 6,675,893 | B2 | 1/2004 | Lund |
| 7,284,603 | B2 | 10/2007 | Ohmer |
| 7,448,448 | B2 | 11/2008 | Lovell et al. |
| 7,493,958 | B2 | 2/2009 | Hromas et al. |
| 2004/0020662 | A1 | 2/2004 | Freyer |
| 2005/0199401 | A1 | 9/2005 | Patel et al. |
| 2008/0185158 | A1 | 8/2008 | Chalker et al. |
| 2008/0266549 | A1 | 10/2008 | Schiedemeyer et al. |
| 2009/0139707 | A1 | 6/2009 | Berzin et al. |
| 2009/0178800 | A1 | 7/2009 | Korte et al. |
| 2009/0205816 | A1 | 8/2009 | De et al. |
| 2009/0205817 | A1 | 8/2009 | Gustafson et al. |
| 2009/0266549 | A1 | 10/2009 | Braithwaite et al. |
| 2010/0175894 | A1 | 7/2010 | Debard et al. |

OTHER PUBLICATIONS

Halliburton, Swellpacker® Lite Isolation System, H05081, dated Aug. 2008, 2 pages.
Halliburton, Swellpacker® OBM System, H04992, dated Aug. 2008, 2 pages.
Halliburton, Swellpacker® Side-Pocket System, H09830, Feb. 2010, 2 pages.
Halliburton, Swellpacker® Stim Isolation System, H06137, dated Aug. 2008, 2 pages.
International Search Report with Written Opinion dated Feb. 9, 2012 for PCT Patent Application No. PCT/US11/040153, 9 pages.
CN Office Action dated Sep. 3, 2014 for CN Patent Application No. 201180032878.8, 5 pages.
English Translation of CN Office Action dated Sep. 3, 2014 for CN Patent Application No. 201180032878.8, 8 pages.
Office Action dated May 22, 2012 for U.S. Appl. No. 12/827,794, 18 pages.
Office Action dated Nov. 30, 2012 for U.S. Appl. No. 12/827,794, 11 pages.
Office Action dated Jun. 28, 2013 for U.S. Appl. No. 12/827,794, 12 pages.
Office Action dated Dec. 5, 2013 for U.S. Appl. No. 12/827,794, 7 pages.
Office Action dated May 23, 2014 for U.S. Appl. No. 12/827,794, 8 pages.
Office Action dated Aug. 29, 2014 for U.S. Appl. No. 12/827,794, 7 pages.

MITIGATING LEAKS IN PRODUCTION TUBULARS

CROSS-REFERENCE TO RELATED APPLICATION

The present application is a continuation of U.S. application Ser. No. 12/827,794, filed on 30 Jun. 2010. The entire disclosure of this prior application is incorporated herein by this reference.

BACKGROUND

This disclosure relates generally to equipment utilized and operations performed in conjunction with a subterranean well and, in an example described below, more particularly provides for mitigating leaks in production tubulars.

Most countries have regulations which prescribe safety measures to be implemented when producing oil or gas (hydrocarbons). These regulations typically require that two barriers are to be provided between the environment and the produced hydrocarbons so that, if one barrier should fail, the other barrier will still prevent release of the hydrocarbons to the environment.

A first barrier is typically provided at the surface in the form of a valve. The second barrier is usually a production packer which seals off an annular space between a production tubing and casing which lines a wellbore.

Typically, the produced hydrocarbons enter the lower end of a production tubing and flow to the surface. A production packer seals off an annulus between the production tubing and the casing.

However, if a leak should develop in the production tubing above the packer (due to, for example, a faulty tubing connection, erosion, corrosion, etc.), then the hydrocarbons can travel to the surface via the annulus. In that situation, only a barrier at the surface (such as a casing valve) will prevent escape of the hydrocarbons to the environment, in violation of safety regulations.

In the past, this situation has been remedied by retrieving the tubing to the surface for repair or replacement (which is very costly and time-consuming), by patching the tubing to stop the leak, or by injecting a hardenable substance into the annulus above the leak to form an annular barrier. There are significant downsides to each of these prior methods.

Therefore, it will be appreciated that improvements are needed in the art of mitigating leaks in production tubulars.

SUMMARY

In the disclosure below, systems and methods are provided which bring improvements to the art of mitigating leaks in production tubulars. One example is described below in which a swellable packer is interconnected in a production tubular string, but the swellable packer is not swollen to seal off an annulus unless and until a leak develops between the interior of the tubular string and the annulus. Another example is described below in which a swellable packer is interconnected in a tubular string between the surface and a conventional mechanically or pressure set packer.

In one aspect, the present disclosure provides to the art a well system which can include a generally tubular production string extending to a surface location. A production packer seals off an annulus external to the production string. A swellable packer is interconnected in the production string between the production packer and the surface location.

In another aspect, this disclosure provides a method of mitigating a leak in a generally tubular production string. The method can include interconnecting a swellable packer in the production string. The swellable packer swells, and thereby increasingly restricting flow through an annulus surrounding the production string, in response to fluid leakage through a sidewall of the production string.

In yet another aspect, a method of mitigating a leak in a generally tubular production string is provided which includes the steps of: interconnecting a swellable packer in the production string; and the swellable packer swelling, and thereby increasingly restricting flow through an annulus surrounding the production string, in response to a flow of hydrocarbons into the annulus from an interior of the production string.

These and other features, advantages and benefits will become apparent to one of ordinary skill in the art upon careful consideration of the detailed description of representative examples below and the accompanying drawings, in which similar elements are indicated in the various figures using the same reference numbers.

DETAILED DESCRIPTION

Figure 1:
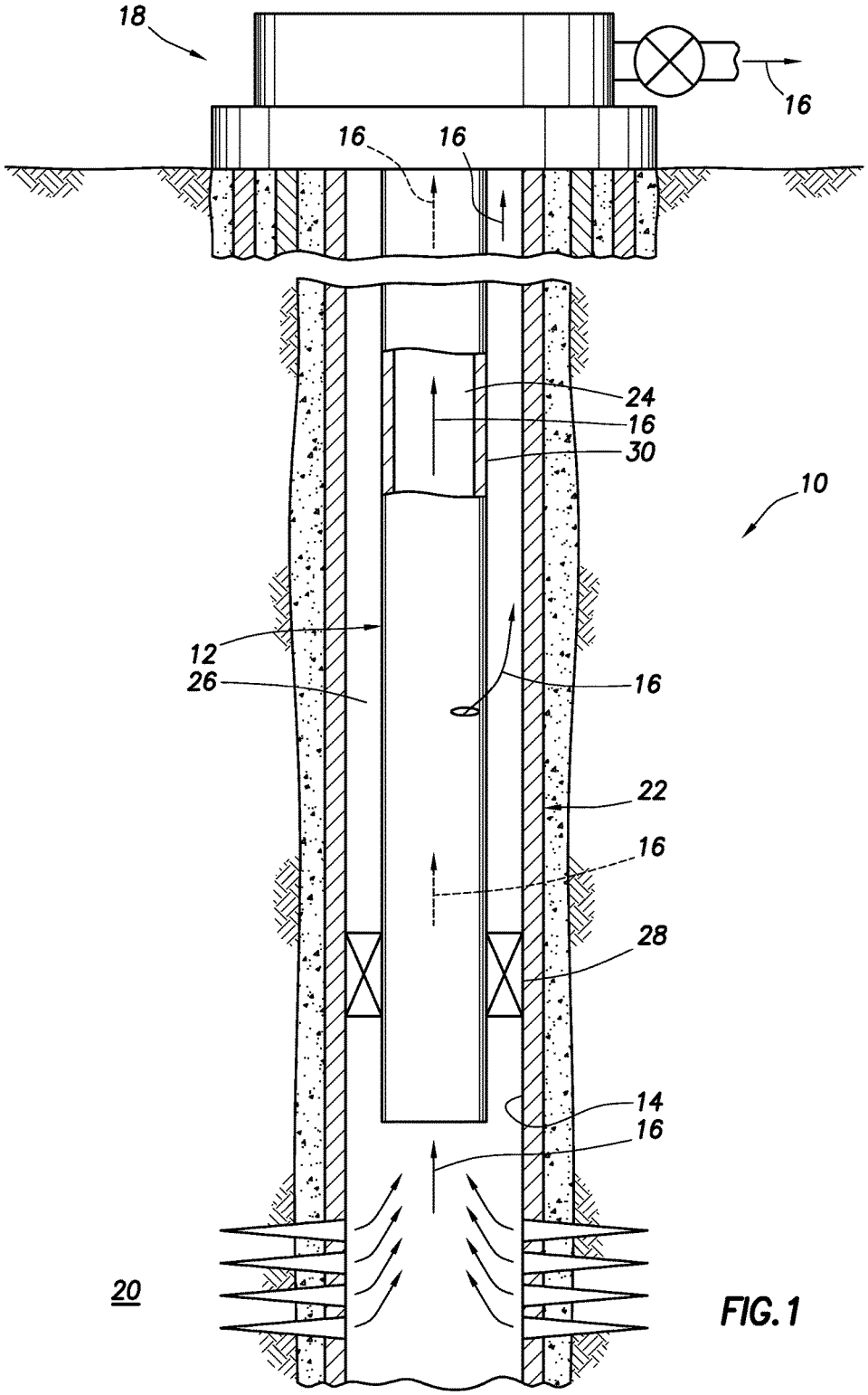
FIG. 1 is a schematic partially cross-sectional view of a well system and associated method which can embody principles of the present disclosure.

Representatively illustrated in FIG. 1 is a well system 10 and associated method which can benefit from the principles of this disclosure. In the well system 10, a tubular production string 12 is installed in a wellbore 14, and fluid 16 is produced (via an interior 24 of the production string) to a surface location 18 from an earth formation 20 intersected by the wellbore.

The surface location 18 can be a land-based, subsea, floating, mudline or other location which is proximate the earth's surface. A wellhead and/or production facility may be disposed at the surface location 18.

The wellbore 14 is depicted in FIG. 1 as being generally vertical, and as being lined with casing 22. However, in other examples, the wellbore 14 could be uncased or open hole, the wellbore could be generally horizontal, inclined relative to vertical, etc.

Although the fluid 16 is depicted as entering a lower end of the production string 12 from one location, in other examples the production string could have one or more valves or other flow control devices for admitting the fluid into the interior 24 of the production string, the fluid could be admitted into the interior of the production string at multiple locations or zones, etc. Thus, it should be clearly understood that the well system 10 is described herein and is illustrated in the drawings as merely one example of how the principles of this disclosure can be beneficially utilized, but those principles are not limited in any way to the details of the well system 10. Instead, the principles of this disclosure can be applied to a wide variety of different well systems.

In normal operations, the fluid 16 is produced from the formation 20 and flows via the interior 24 of the production string 12 to the surface location 18. However, if a leak should develop which allows the fluid 16 to enter an annulus 26 between the production string 12 and the wellbore 14, the fluid could flow to the surface location 18 via the annulus, in violation of regional or national safety regulations.

Note that a production packer 28 (such as a mechanically or pressure set packer, etc.) would normally serve as a pressure barrier to prevent flow of the fluid 16 to the surface via the annulus 26, but if the leak occurs at a location between the production packer and the surface, the production packer is not able to prevent flow of the fluid into the annulus above the packer.

The leak could occur for any of a variety of reasons. For example, a sidewall 30 of the production string 12 could be eroded, oxidized or corroded over time due to the fluid 16 and/or chemicals in the fluid flowing through the production string. As another example, one or more threaded connections in the production string 12 can fail, and thereby provide fluid communication between the interior of the production string and the annulus 26 via the sidewall 30 of the production string.

Figure 2:
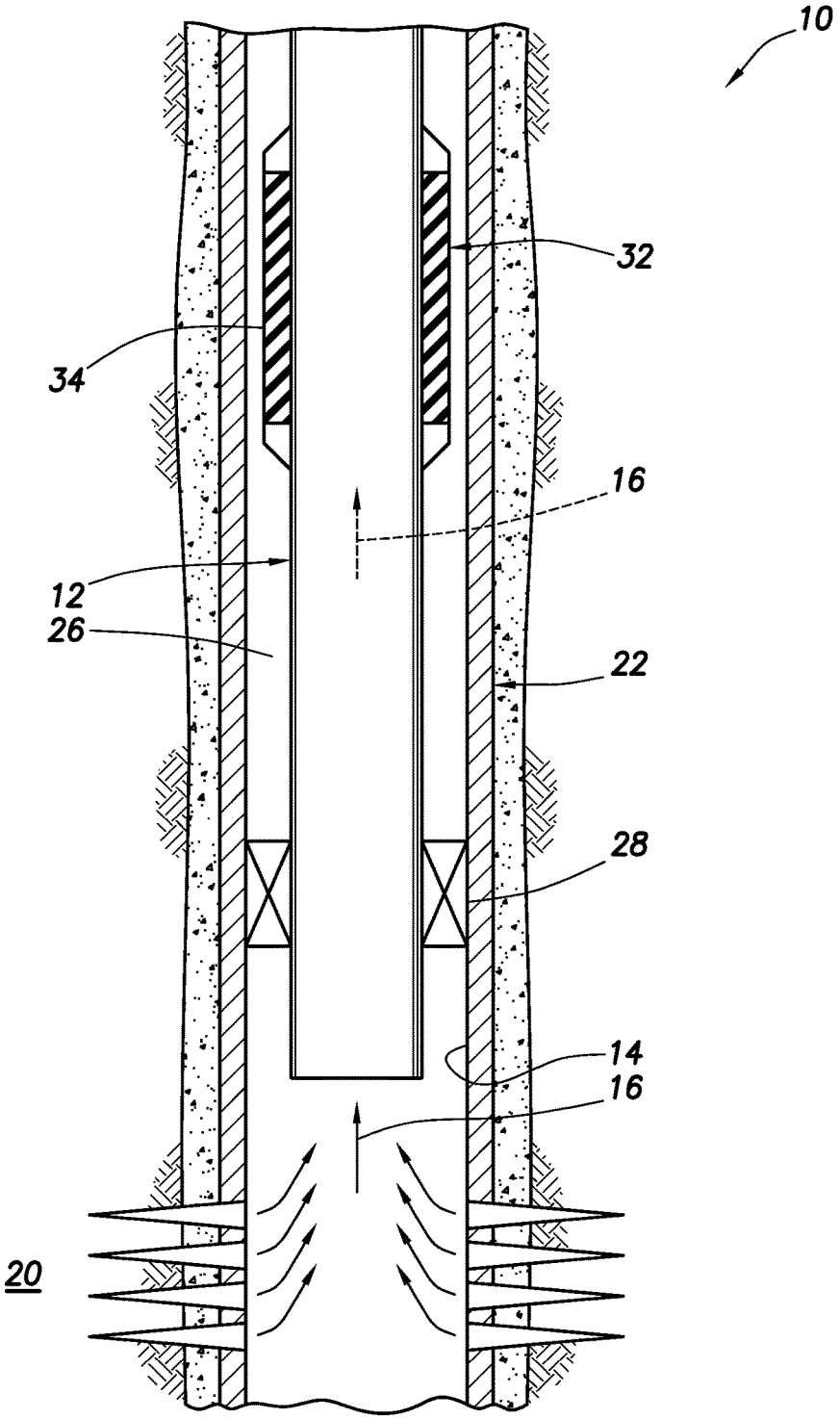
FIG. 2 is a schematic partially cross-sectional view of a portion of the well system of FIG. 1, with a swellable packer being positioned between a production packer and a surface location.

Referring additionally now to FIG. 2, the well system 10 is representatively illustrated in a configuration which embodies principles of the present disclosure. In this configuration, a swellable packer 32 is interconnected in the production string 12 between the production packer 28 and the surface location 18 (not visible in FIG. 2, see FIG. 1).

After the production packer 28 is set in the wellbore 14 (e.g., by mechanically manipulating the production string, by applying pressure to the production packer, etc.), the fluid 16 is produced from the formation 20 to the surface location 18 via the interior 24 of the production string. If no leaks occur between the interior 24 of the production string 12 and the annulus 26, then preferably the swellable packer 32 remains unset.

If, however, a leak does occur, then the swellable packer 32 is set, thereby preventing (or at least mitigating) flow of the fluid 16 to the surface location 18 via the annulus 26. The swellable packer 32 is set by swelling a swellable material 34 of the packer.

The swellable material 34 swells when contacted by a predetermined activating agent. The term "swell" and similar terms (such as "swellable") are used herein to indicate an increase in volume of a swellable material.

Typically, this increase in volume is due to incorporation of molecular components of the activating agent into the swellable material itself, but other swelling mechanisms or techniques may be used, if desired. Note that swelling is not the same as expanding, although a seal material may expand as a result of swelling.

For example, in some conventional packers, a seal element may be expanded radially outward by longitudinally compressing the seal element, or by inflating the seal element. In each of these cases, the seal element is expanded without any increase in volume of the seal material of which the seal element is made. Thus, in these conventional packers, the seal element expands, but does not swell.

The activating agent which causes swelling of the swellable material 34 is preferably a hydrocarbon fluid (such as oil or gas). In the well system 10, the swellable material 34 can swell when the fluid 16 comprises the activating agent, and the fluid leaks into the annulus 26.

The swollen material 34 then seals off the annulus 26, or at least increasingly restricts flow of the fluid 16 through the annulus.

Various swellable materials are known to those skilled in the art, which materials swell when contacted with hydrocarbon fluid, so a comprehensive list of these materials will not be presented here. Partial lists of swellable materials may be found in U.S. Pat. Nos. 3,385,367, 7,059,415 and 7,143,832, and in International Application No. PCT/NO2005/000170 (published as WO 2005/116394), the entire disclosures of which are incorporated herein by this reference.

It should, thus, be clearly understood that any swellable material which swells when contacted by a predetermined activating agent may be used in keeping with the principles of this disclosure. The activating agent is not necessarily a hydrocarbon, but could instead be water, other types of gas, etc.

Figure 3:
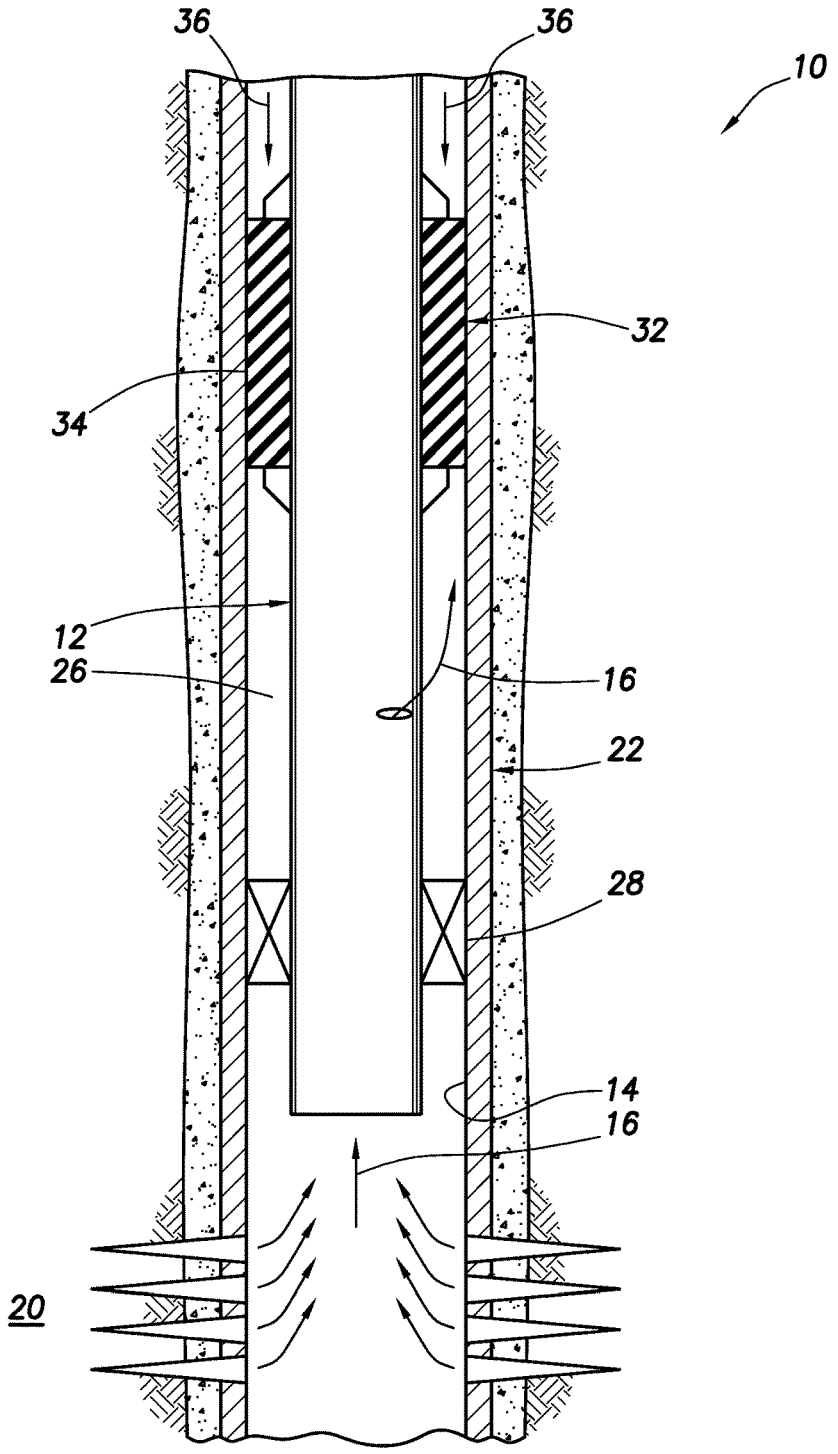
FIG. 3 is a schematic cross-sectional view of the well system, with the swellable packer being set.

Referring additionally now to FIG. 3, the well system 10 is representatively illustrated after the swellable material 34 has swollen. Swelling of the swellable material 34 can be in response to the fluid 16 comprising an activating agent and leaking into the annulus 26. The swellable packer 32, thus, can remain dormant or unset in the annulus 26 until a leak occurs, at which point the swellable material 34 swells and closes off, or at least restricts, flow of the fluid 16 through the annulus.

Alternatively, or in addition, an activating agent 36 can be placed in contact with the swellable material 34, whether or not the leak has occurred, and whether or not the fluid 16 has flowed into the annulus 26. For example, the activating agent 36 could be flowed into the annulus 26 from the surface location 18 or another remote location, the activating agent could be released from a downhole reservoir, the activating agent could be contained initially in the swellable packer 32, etc. Thus, the principles of this disclosure are not limited to any particular source of the activating agent 36.

It may now be fully appreciated that this disclosure provides several advancements to the art of mitigating leaks in production tubulars. In the well system 10 and associated method, there is no need to inject a hardenable plug into the annulus 26, no need to set a patch in the production string 12 and no need to retrieve the production string to the surface for repair or replacement.

The above disclosure provides to the art a well system 10 which can include a generally tubular production string 12 extending to a surface location 18. A production packer 28 seals off an annulus 26 external to the production string 12. A swellable packer 32 is interconnected in the production string 12 between the production packer 28 and the surface location 18.

The swellable packer 32 may swell and increasingly restrict flow through the annulus 26 in response to fluid 16 leakage through a sidewall 30 of the production string 12.

The swellable packer 32 may swell and increasingly restrict flow through the annulus 26 in response to a flow of hydrocarbons into the annulus 26 from an interior 24 of the production string 12.

The swellable packer 32 may comprise a swellable material 34 which increases in volume in response to contact with an activating agent 36.

The activating agent 36 may comprise hydrocarbons or water. The activating agent 36 may be flowed into the annulus 26 from a remote location.

The above disclosure also describes a method of mitigating a leak in a generally tubular production string 12. The method can include interconnecting a swellable packer 32 in the production string 12. The swellable packer 32 swells, and thereby increasingly restricts flow through an annulus 26 surrounding the production string 12, in response to fluid 16 leakage through a sidewall 30 of the production string 12.

The swelling step may be performed in response to a flow of hydrocarbons into the annulus 26 from an interior 24 of the production string 12. The swelling step may be performed only after the hydrocarbons flow through the interior 24 of the production string 12.

The swellable packer 32 can comprise a swellable material 34 which increases in volume in response to contact with an activating agent 36.

The interconnecting step can include interconnecting the swellable packer 32 in the production string 12 between a production packer 28 and a surface location 18.

Another method of mitigating a leak in a generally tubular production string 12 can include interconnecting a swellable packer 32 in the production string 12. The swellable packer 32 swells, and thereby increasingly restricts flow through an annulus 26 surrounding the production string 12, in response to a flow of hydrocarbons into the annulus 26 from an interior 24 of the production string 12.

The method can include mechanically setting the production packer 28. The method can include setting the production packer 28 by applying pressure to the production packer 28.

The method can include setting the production packer 28 prior to the hydrocarbons flowing through the interior 24 of the production string 12. The swelling step may be performed only after the hydrocarbons flow through the interior 24 of the production string 12.

It is to be understood that the various examples described above may be utilized in various orientations, such as inclined, inverted, horizontal, vertical, etc., and in various configurations, without departing from the principles of the present disclosure. The embodiments illustrated in the drawings are depicted and described merely as examples of useful applications of the principles of the disclosure, which are not limited to any specific details of these embodiments.

In the above description of the representative examples of the disclosure, directional terms, such as "above," "below," "upper," "lower," etc., are used for convenience in referring to the accompanying drawings. In general, "above," "upper," "upward" and similar terms refer to a direction toward the earth's surface along a wellbore, and "below," "lower," "downward" and similar terms refer to a direction away from the earth's surface along the wellbore.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A well system, comprising:

a generally tubular production string positioned within a wellbore which intersects one or more earth formations which contain at least one production fluid, the production string extending to a surface location;

a set production packer which seals off an annulus external to the production string during production of the fluid to the surface location via the production string, the production packer being positioned between the surface location and one of the earth formations that is nearest the surface location; and a swellable packer interconnected in the production string between the production packer and the surface location, wherein the production string includes production fluid in an interior thereof but the annulus external to the production string and above the set production packer is free of production fluids, wherein the set production packer and the swellable packer are both exposed to the annulus, wherein the set production packer seals off the annulus but the swellable packer is unset and wherein the swellable packer is of a swellable material configured to swell to seal off the annulus in response to leakage of the fluid through a sidewall of the production string into the annulus.

2. The well system of claim 1, wherein the swellable packer swells in response to a flow of hydrocarbons into the annulus from an interior of the production string, thereby sealing off the annulus.

3. The well system of claim 1, wherein the swellable packer comprises a swellable material which increases in volume in response to contact with an activating agent.

4. The well system of claim 3, wherein the activating agent comprises hydrocarbons.

5. The well system of claim 3, wherein the activating agent comprises water.

6. The well system of claim 3, wherein the activating agent comprises a gas.

* * * * *